US009840022B2

(12) United States Patent
Rodler

(10) Patent No.: US 9,840,022 B2
(45) Date of Patent: Dec. 12, 2017

(54) ANGLED SHEAR SAFETY GUIDE SPLITTING SYSTEM FOR WOOD/LOG SPLITTERS

(71) Applicant: Walter Rodler, Debert (CA)

(72) Inventor: Walter Rodler, Debert (CA)

( * ) Notice: Subject to any disclaimer, the term of this patent is extended or adjusted under 35 U.S.C. 154(b) by 446 days.

(21) Appl. No.: 14/578,557

(22) Filed: Dec. 22, 2014

(65) Prior Publication Data

US 2016/0176067 A1 Jun. 23, 2016

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
USPC ..... 144/193.1, 193.2, 195.8, 195.1, 195.7, 144/195.9
See application file for complete search history.

(56) References Cited

U.S. PATENT DOCUMENTS

| | | | | |
|---|---|---|---|---|
| 4,141,396 | A | 2/1979 | McCallister | |
| 4,303,112 | A | 12/1981 | Sconce | |
| 4,498,293 | A | 2/1985 | Gregory | |
| 5,375,638 | A | 12/1994 | Green et al. | |
| 7,124,704 | B1 | 10/2006 | Marx | |
| 7,159,627 | B2 * | 1/2007 | St-Germain | B27L 7/005 144/195.5 |
| 2011/0079323 | A1 * | 4/2011 | Green | B27L 7/00 144/195.8 |
| 2011/0304087 | A1 | 12/2011 | Gibson | |

* cited by examiner

*Primary Examiner* — Matthew G Katcoff
(74) *Attorney, Agent, or Firm* — Christopher Pilling

(57) ABSTRACT

An angled shear safety guide log splitting system has an elongated frame having parallel elongated guides attached thereto. A pressure plate adapted to be pushed by a utility piston and slide along the guides in a linear direction, and an angled shear member having a cutting edge member that is located at a distal end of the frame, wherein the angled shear member is shaped and positioned upon the frame at an angle such that a top portion of the cutting edge member is adapted to touch a log positioned upon the frame first followed successively downwardly by the rest of the cutting edge member to thereby more easily and efficiently split the log when pushed by the pressure plate.

5 Claims, 4 Drawing Sheets

ANGLED SHEAR SAFETY GUIDE SPLITTING SYSTEM FOR WOOD/LOG SPLITTERS

FIELD OF THE INVENTION

The present invention relates generally to lumber equipment but more particularly to an angled shear safety guide splitting system for wood/log splitters.

BACKGROUND OF THE INVENTION

Log splitting machines have been around for over a century, starting with steam powered splitters to accelerate the work of manual splitting using an ax. Nowadays, with hydraulic system powered by diesel, gas, or even electric motors, it becomes even easier and faster. Still, there is some room for improvement, more specifically with the cutting blade, or wedge. Typically, a splitting wedge is shaped like an isosceles triangle with the apex being the cutting member and onto which a log is pushed. The sides of the wedge splay the log as it passes along them. The angle of the wedge makes the log splay quite a lot and thus requires a strong pressure from the piston to continue the splitting of the log which is as much accomplished by the splaying than it is by the sharpness of the tip of the wedge. That splaying action, can be accomplished even if the width of the wedge is smaller than the diameter of the log. It does, however, require more force coming from the piston pushing the log. An optimal angle and size has to be found so as to make it possible to split a log with a less powerful piston. When jamming of any object, it requires more power. When shearing an object it requires 50% less power or force.

SUMMARY OF THE INVENTION

It is a main advantage of this invention to provide for a shear having optimal characteristics to split logs or planks while using a less powerful piston by way of shearing.

In order to do so, the angled shear safety guide log splitting system has an elongated frame having parallel elongated guides attached thereto. A pressure plate adapted to be pushed by a utility piston and slide along the guides in a linear direction, and an angled shear member having a cutting edge member that is located at a distal end of the frame, wherein the angled shear member is shaped and positioned upon the frame at an angle such that a top portion of the cutting edge member is adapted to touch a log positioned upon the frame first followed successively downwardly by the rest of the cutting edge member to thereby more easily and efficiently split the log when pushed by the pressure plate.

The log splitting system has the frame member formed in the shape of an "I" beam.

The log splitting system has the elongated guides "L" shaped and securely attached to opposite sides of the "I" beam.

The log splitting system has the pressure plate shaped to engage both the elongated guides such that it can smoothly move in a back-and-forth linear direction thereon.

The log splitting system wherein the pressure plate includes a flat portion having a series of ridges thereon adapted to engage, hold, and push the log into the shear member.

The log splitting system has the cutting edge member formed having a front edge cutting angle having a width that is chosen and adapted to split the log into thin kindling strips.

The log splitting system is further comprised of a utility piston connected between the frame and the pressure plate and adapted to push the pressure plate along the guides in a linear direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF A PREFERRED EMBODIMENT

Figure 1:
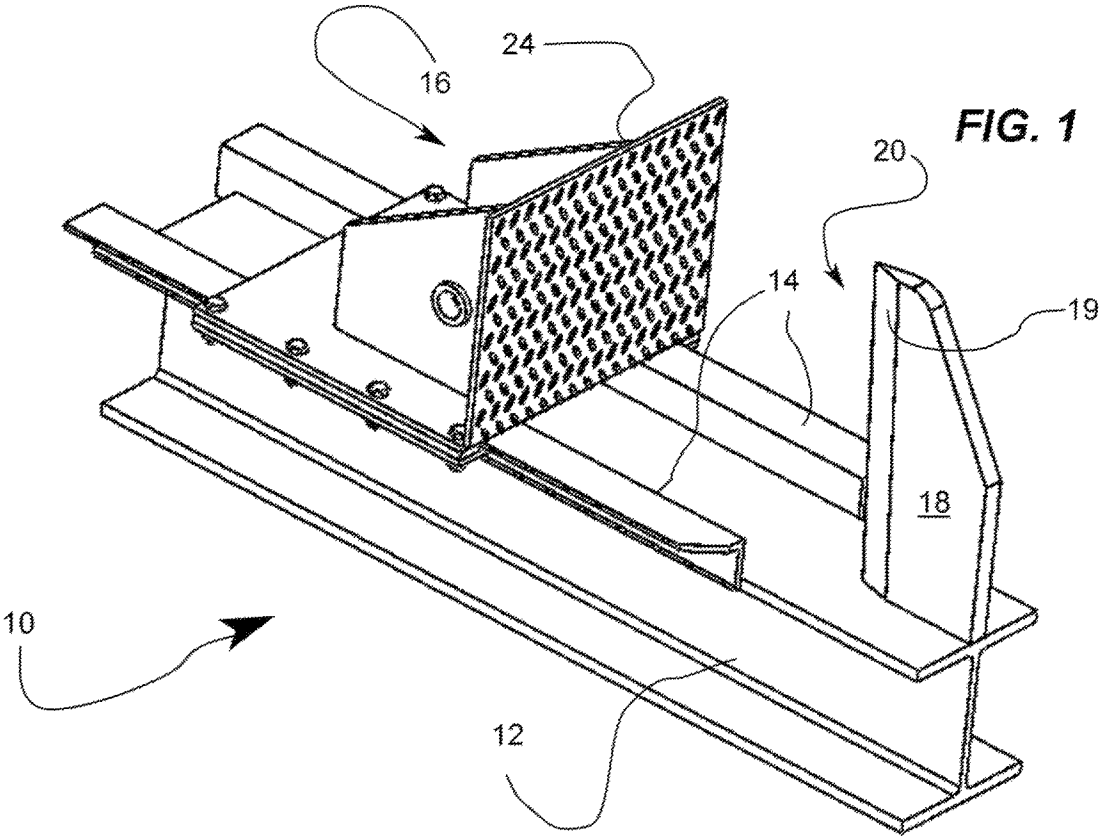
FIG. 1 Isometric view of the invention.
Figure 2:
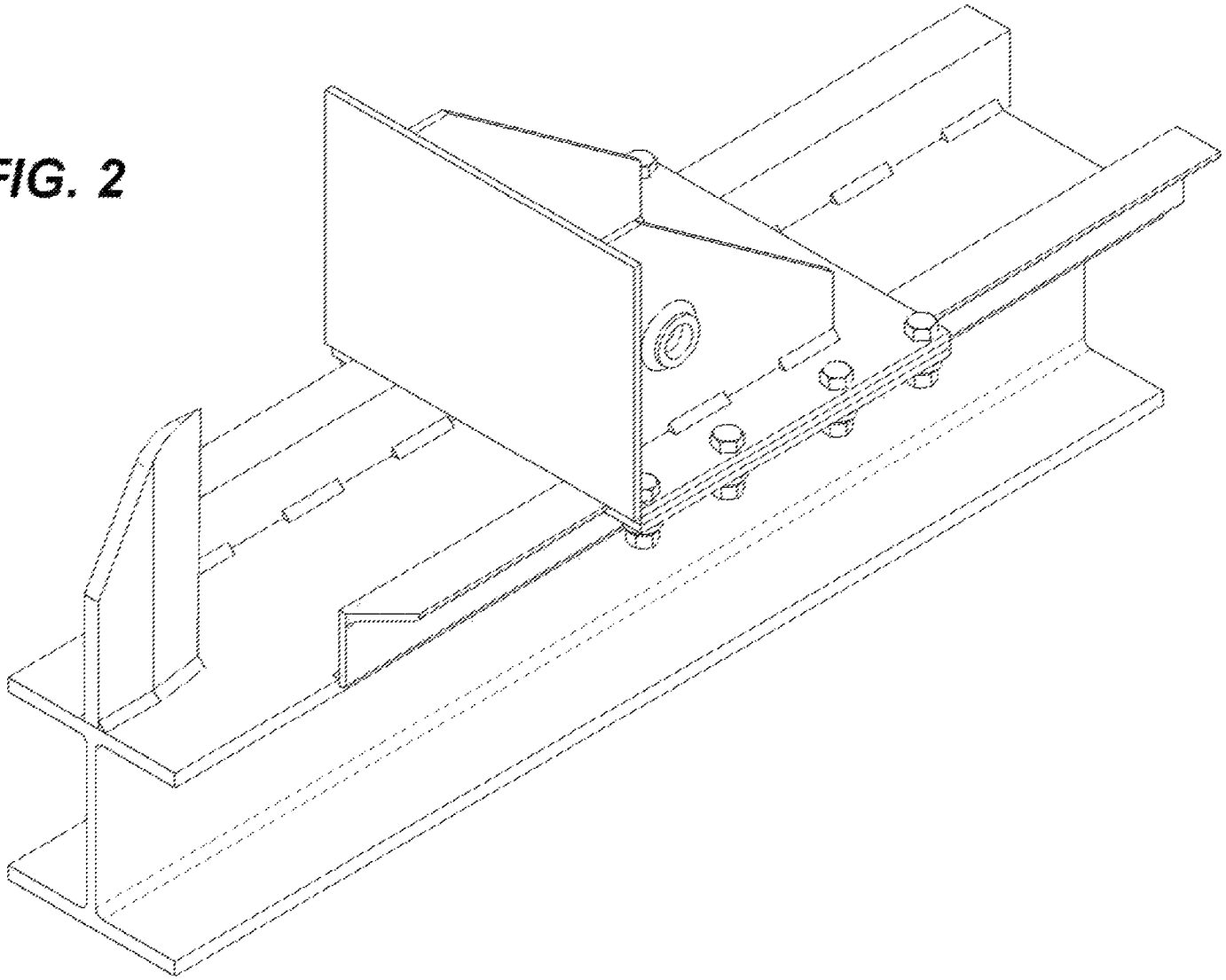
FIG. 2 Reverse angle isometric view.
Figure 3:
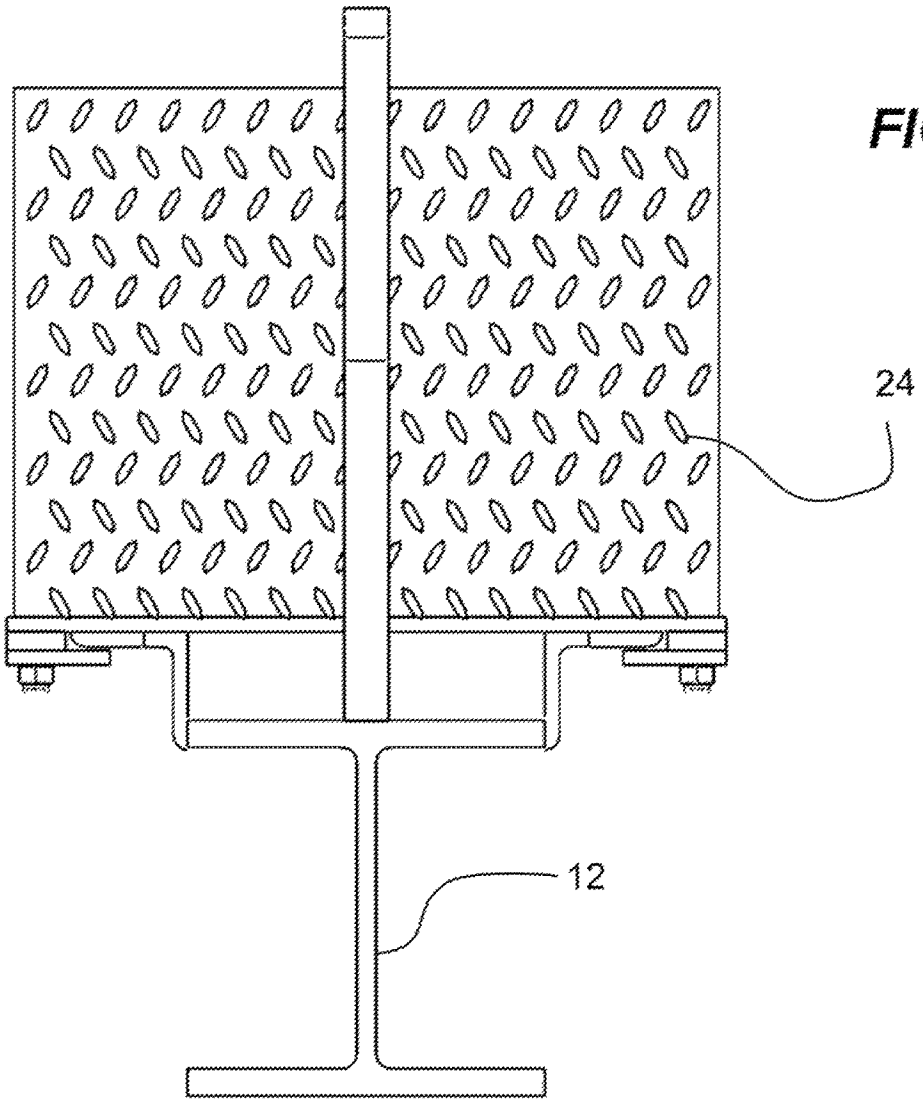
FIG. 3 Front view.
Figure 4:
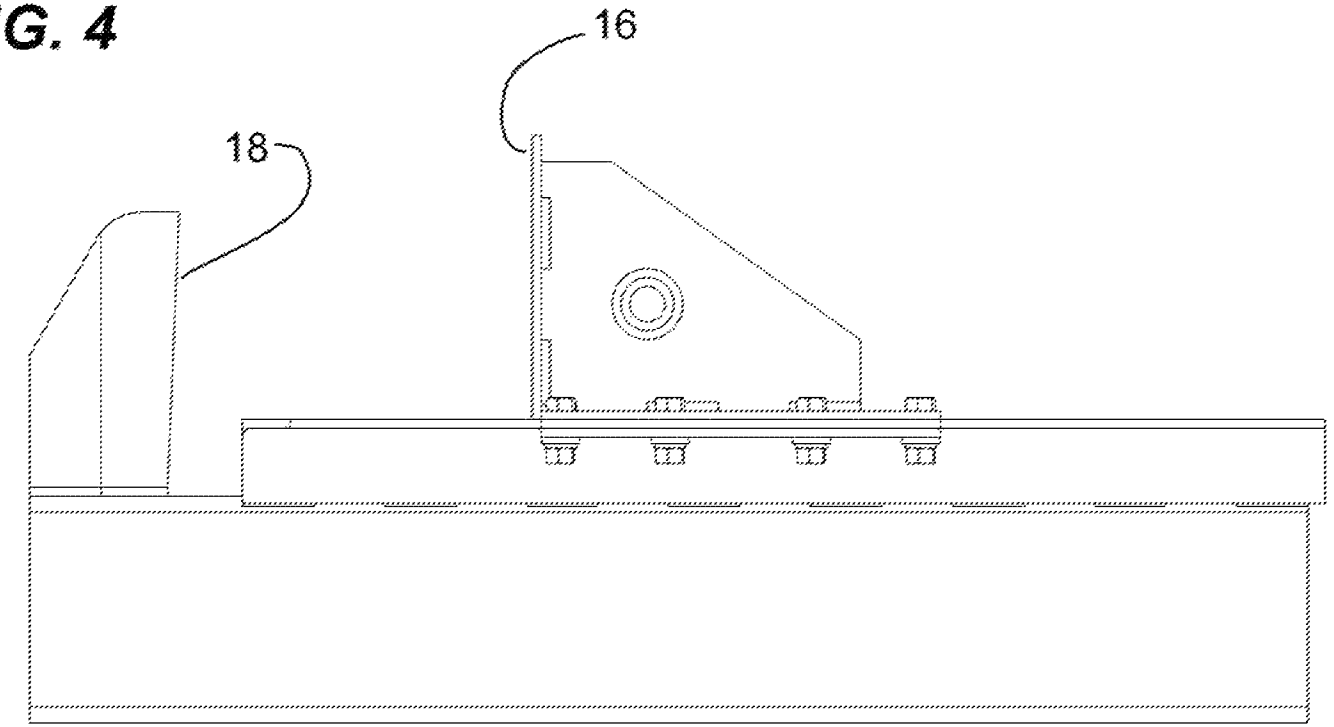
FIG. 4 Side view.

An angled shear safety guide splitting system (10) for wood/log splitters has an elongated frame (12) comprised of two elongated and parallel guides (14) and a slidable pressure plate (16). The pressure plate (16) moves linearly along the guides (14) while being pushed by a utility piston (not shown). The frame (12) is formed in the shape of an "I" beam, and the guides (14) are "L" shaped.

The pressure plate (16) is configured and shaped to engage both the elongated guides (14) so as to move smoothly linearly, back and forth thereon.

A log (22), is pushed by the pressure plate (16) onto an angled shear member (18). The angled shear member (18) has a slight forward lean to make a top portion (19) of an edge member (20) touch the log first, followed progressively downward by the rest of the edge member (20). The angled shear member (18) is more efficient than a traditional splitter (not shown) specifically because of the forward lean and the edge member (20) has an edge angle that is very small so as to be very thin in its width.

This angle allows for a splitting with a smaller splaying of the log, and as such requires less pressure force from the pressure plate (16). This also impacts on the strength required on other components of the splitting system (10), and makes them smaller, lighter and thus a more practical machine. Because of the reduced splaying and the thinness of the edge member (20), It is possible to split logs or planks into thin kindling strips. The pressure plate (16) includes a flat portion (24) having a series of ridges (26) thereon adapted to engage, hold, and push the log into the shear member (18).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An angled shear safety guide log splitting system comprising an elongated I-beam frame haying parallel elongated guides attached thereto, wherein said parallel elongated guides are L-shaped and fixedly attached to opposite sides of said elongated I-beam frame and said parallel elongated guides secure a log positioned upon said frame during splitting; a pressure plate adapted to slide along said parallel elongated guides in a linear direction; and an angled shear member having a cutting edge member located at a distal end of said frame, wherein said angled shear member is shaped and positioned upon said frame at an angle such that a top portion of said cutting edge member is adapted to touch said log positioned upon said frame first followed successively downwardly by the rest of said cutting edge member to thereby more easily and efficiently split said log when pushed by said pressure plate.

2. The angled shear safety guide log splitting system of claim 1, wherein said pressure plate is shaped to engage both said elongated guides such that it can smoothly moves in a back-and-forth linear direction thereon.

3. The angled shear safety guide log splitting system of claim 1, wherein said pressure plate includes a flat portion having a series of ridges thereon adapted to engage, hold, and push said log into said shear member.

4. The angled shear safety guide log splitting system of claim 1, wherein said cutting edge member is formed having a front edge cutting angle having a width that is chosen and adapted to split said log into thin kindling strips.

5. The angled shear safety guide log splitting system of claim 1, further comprising a utility piston connected between said frame and said pressure plate and adapted to push said pressure plate along said guides in a linear direction.

* * * * *